US006698546B1

(12) United States Patent
Sandor, Sr.

(10) Patent No.: US 6,698,546 B1
(45) Date of Patent: Mar. 2, 2004

(54) LADDER STABILIZER AND METHOD OF USE

(76) Inventor: Frederick J. Sandor, Sr., 407 St. George Ct., Satellite Beach, FL (US) 32937

( * ) Notice: Subject to any disclaimer, the term of this patent is extended or adjusted under 35 U.S.C. 154(b) by 0 days.

(21) Appl. No.: 10/158,535

(22) Filed: May 31, 2002

(51) Int. Cl.[7] ..... E04G 5/02; E06C 7/06; E06C 7/14

(52) U.S. Cl. ..... 182/107; 182/214; 248/210

(58) Field of Search ..... 182/116, 20, 187, 182/135, 136, 188, 107, 214, 129; 248/210, 211, 238

(56) References Cited

U.S. PATENT DOCUMENTS 2,808,975 A * 10/1957 Palmquist ..... 182/107
3,336,999 A * 8/1967 McSwain ..... 182/187 X
3,407,900 A * 10/1968 Hopfeld ..... 182/107
3,828,889 A * 8/1974 Rehm ..... 182/107
4,100,999 A * 7/1978 Conner ..... 182/187 X
4,379,498 A * 4/1983 Krusmark ..... 182/107
4,946,004 A 8/1990 Henson
5,622,238 A * 4/1997 Farmer ..... 182/214
5,638,916 A 6/1997 Schneider
5,850,894 A * 12/1998 Busenhart ..... 182/214
5,975,389 A * 11/1999 Braun et al. ..... 182/187
6,244,382 B1 6/2001 Labonte

* cited by examiner

*Primary Examiner*—Hugh B. Thompson, II
(74) *Attorney, Agent, or Firm*—John H. Crozier

(57) ABSTRACT

A ladder stabilizer, including: a serrated portion for placement against an object; and the serrated portion being attachable to an upper end of a ladder, with serrations formed on the serrated portion engaging the object.

3 Claims, 5 Drawing Sheets

LADDER STABILIZER AND METHOD OF USE

BACKGROUND OF THE INVENTION

1. Field of the Invention

The present invention relates to ladders generally and, more particularly, but not by way of limitation, to a novel ladder stabilizer that is easily manufactured and used.

2. Background Art

A ladder stabilizers is provided at the upper end of a ladder to engage an object, typically a pole or a tree, to minimize the possibility of slipping and sliding of the ladder against the object, thus minimizing the possibility of injury to, or the death of, a user of the ladder should slipping or sliding of the ladder occur. Some known ladder stabilizers are described in the following patents. U.S. Pat. No. 6,154,521, issued Nov. 28, 2000, to Campbell, and titled GYRATING ANODE X-RAY TUBE, describes an x-ray tube having a gyrating anode having a convex spherical surface.

U.S. Pat. No. 6,185,276, issued Feb. 6, 2001, describes an x-ray tube having a concave, stationary anode U.S. Pat. No. 2,808,975, issued Oct. 8, 1957, to Palmquist, and titled POLE REST ATTACHMENTS FOR LADDERS, describes a ladder stabilizer that, with reference to FIGS. 1 and 2, has an arcuate toothed structure that rests against a pole. The structure is obviously designed for a specific pole diameter, as it could not safely engage a wide range of diameters of poles.

U.S. Pat. No. 3,407,900, issued Oct. 29, 1968, to Hopfeld, and titled POLE ENGAGING DEVICE FOR LADDERS, describes a ladder stabilizer consisting of an arcuate strap having what is referred to as "a series of spaced friction projections". It is not clear that the friction projections would really be of much use. Also, the strap is limited in the range of diameters it could safely accommodate.

U.S. Pat. No. 4,349,498, issued Apr. 12, 1983, to Krusmark, and titled SAFETY DEVICE FOR LADDERS, describes a ladder stabilizer that includes an elongated, serrated member that grips a tree or pole. It appears that the range of diameters of the tree or pole is not too limited, but the device includes a number of moving parts.

U.S. Pat. No. 4,946,004, issued Aug. 7, 1990, to Henson, and titled POLE GRIPPING LADDER STABILIZING DEVICE, describes a ladder stabilizer that is relatively complicated in that it has moving parts that substantially encircle a pole or tree. It also appears that the device would be somewhat limited in the diameters of poles or trees that could be accommodated.

U.S. Pat. No. 5,638,916, issued Jun. 17, 1997, to Schneider, and titled LADDER SAFETY ATTACHMENT, describes a ladder stabilizer that also has moving parts and also appears to be somewhat limited in the diameters of poles or trees that could be accommodated.

U.S. Pat. No. 6,244,382, issued Jun. 12, 2001, to Labonte, and titled ATTACHMENT FOR STABILIZING AN EXTENSION LADDER, describes a ladder stabilizer that has many moving parts, although it may be able to accommodate pole or tree diameters in a somewhat greater range than some of the above devices. U.S. Pat. No. 2,808,975, issued Oct. 8, 1957, to Palmquist, and titled POLE REST ATTACHMENTS FOR LADDERS, describes a ladder stabilizer that, with reference to FIGS. 1 and 2, has an arcuate toothed structure that rests against a pole. The structure is obviously designed for a specific pole diameter, as it could not safely engage a wide range of diameters of poles.

U.S. Pat. No. 3,407,900, issued Oct. 29, 1968, to Hopfeld, and titled POLE ENGAGING DEVICE FOR LADDERS, describes a ladder stabilizer consisting of an arcuate strap having what is referred to as "a series of spaced friction projections". It is not clear that the friction projections would really be of much use. Also, the strap is limited in the range of diameters it could safely accommodate.

U.S. Pat. No. 4,349,498, issued Apr. 12, 1983, to Krusmark, and titled SAFETY DEVICE FOR LADDERS, describes a ladder stabilizer that includes an elongated, serrated member that grips a tree or pole. It appears that the range of diameters of the tree or pole is not too limited, but the device includes a number of moving parts.

U.S. Pat. No. 4,946,004, issued Aug. 7, 1990, to Henson, and titled POLE GRIPPING LADDER STABILIZING DEVICE, describes a ladder stabilizer that is relatively complicated in that it has moving parts that substantially encircle a pole or tree. It also appears that the device would be somewhat limited in the diameters of poles or trees that could be accommodated.

U.S. Pat. No. 5,638,916, issued Jun. 17, 1997, to Schneider, and titled LADDER SAFETY ATTACHMENT, describes a ladder stabilizer that also has moving parts and also appears to be somewhat limited in the diameters of poles or trees that could be accommodated.

U.S. Pat. No. 6,244,382, issued Jun. 12, 2001, to Labonte, and titled ATTACHMENT FOR STABILIZING AN EXTENSION LADDER, describes a ladder stabilizer that has many moving parts, although it may be able to accommodate pole or tree diameters in a somewhat greater range than some of the above devices. U.S. Pat. No. 2,808,975, issued Oct. 8, 1957, to Palmquist, and titled POLE REST ATTACHMENTS FOR LADDERS, describes a ladder stabilizer that, with reference to FIGS. 1 and 2, has an arcuate toothed structure that rests against a pole. The structure is obviously designed for a specific pole diameter, as it could not safely engage a wide range of diameters of poles.

U.S. Pat. No. 3,407,900, issued Oct. 29, 1968, to Hopfeld, and titled POLE ENGAGING DEVICE FOR LADDERS, describes a ladder stabilizer consisting of an arcuate strap having what is referred to as "a series of spaced friction projections". It is not clear that the friction projections would really be of much use. Also, the strap is limited in the range of diameters it could safely accommodate.

U.S. Pat. No. 4,349,498, issued Apr. 12, 1983, to Krusmark, and titled SAFETY DEVICE FOR LADDERS, describes a ladder stabilizer that includes an elongated, serrated member that grips a tree or pole. It appears that the range of diameters of the tree or pole is not too limited, but the device includes a number of moving parts.

U.S. Pat. No. 4,946,004, issued Aug. 7, 1990, to Henson, and titled POLE GRIPPING LADDER STABILIZING DEVICE, describes a ladder stabilizer that is relatively complicated in that it has moving parts that substantially encircle a pole or tree. It also appears that the device would be somewhat limited in the diameters of poles or trees that could be accommodated.

U.S. Pat. No. 5,638,916, issued Jun. 17, 1997, to Schneider, and titled LADDER SAFETY ATTACHMENT, describes a ladder stabilizer that also has moving parts and also appears to be somewhat limited in the diameters of poles or trees that could be accommodated.

U.S. Pat. No. 6,244,382, issued Jun. 12, 2001, to Labonte, and titled ATTACHMENT FOR STABILIZING AN EXTENSION LADDER, describes a ladder stabilizer that has many moving parts, although it may be able to accommodate pole or tree diameters in a somewhat greater range than some of the above devices.

None of the above devices is simple and has no moving parts. Additionally, most of the above devices cannot accommodate a relatively wide range of diameters of objects.

Accordingly, it is a principal object of the present invention to provide a ladder stabilizer that can be economically manufactured and easily used.

It is a further object of the present invention to provide such a ladder stabilizer that can accommodate a relatively wide range of diameters of objects.

It is an additional object of the present invention to provide such a ladder stabilizer that has no moving parts.

It is another object of the present invention to provide such a ladder stabilizer that can be quickly attached to or removed from the end of a ladder.

Other objects of the present invention, as well as particular features, elements, and advantages thereof, will be elucidated in, or be apparent from, the following description and the accompanying drawing figure.

SUMMARY OF THE INVENTION

The present invention achieves the above objects, among others, by providing, in a preferred embodiment, a ladder stabilizer, comprising: a serrated portion for placement against an object; and said serrated portion being attachable to an upper end of a ladder, with serrations formed on said serrated portion engaging said object.

BRIEF DESCRIPTION OF THE DRAWING

Understanding of the present invention and the various aspects thereof will be facilitated by reference to the accompanying drawing figures, provided for purposes of illustration only and not intended to define the scope of the invention, on which.

DETAILED DESCRIPTION OF THE PREFERRED EMBODIMENTS

Figure 1:
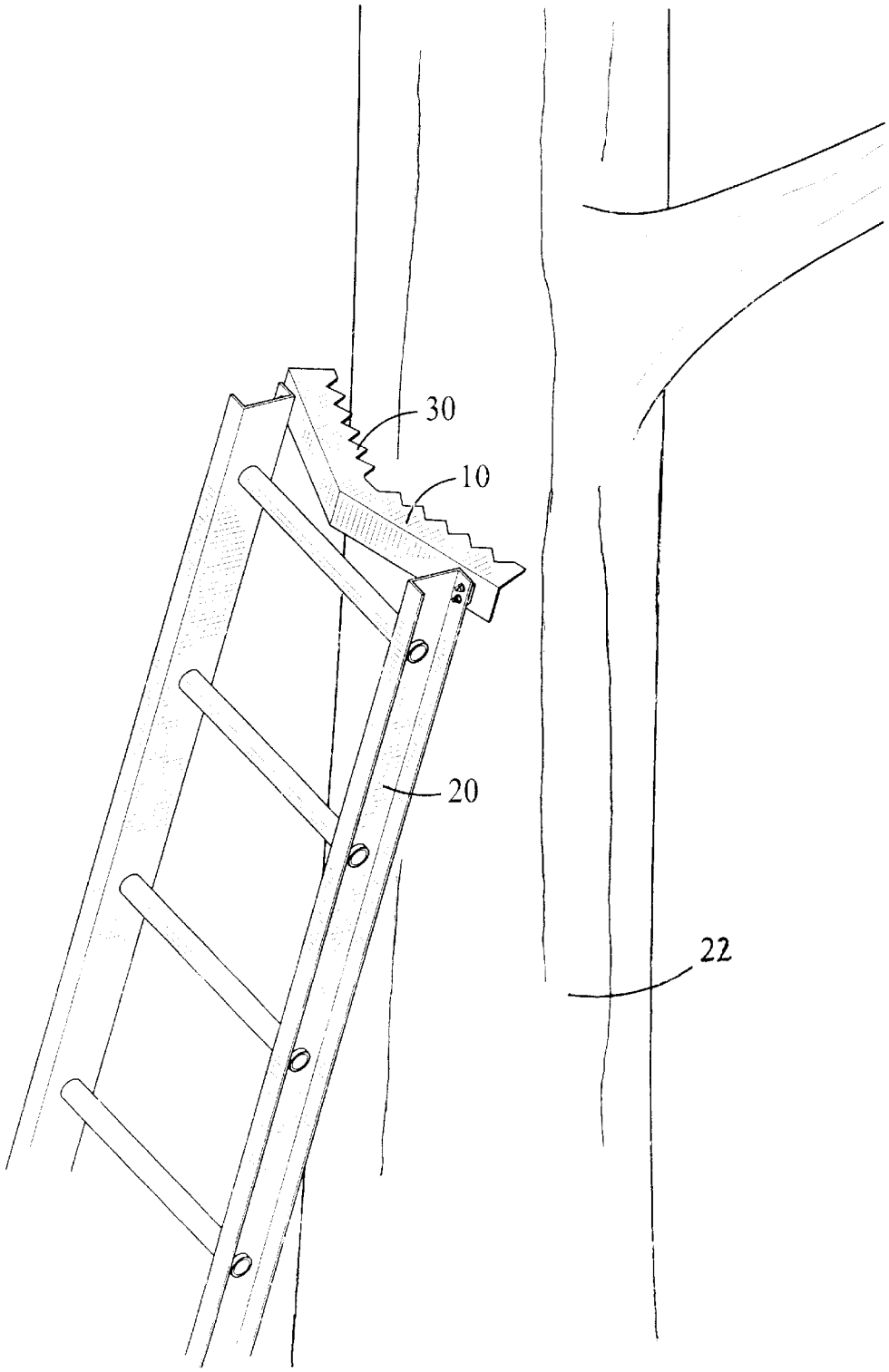
FIG. 1 is an isometric view of the ladder stabilizer of the present invention, attached to the upper end of a metal ladder, and placed against an object.

Reference should now be made to the drawing figures on which similar or identical elements are given consistent identifying numerals throughout the various figures thereof, and on which parenthetical references to figure numbers, when used, direct the reader to the view(s) on which the element(s) being described is (are) best seen, although the element(s) may be seen on other figures also.

FIG. 1 illustrates a ladder stabilizer, constructed according to the present invention, and generally indicated by the reference numeral 10. Ladder stabilizer 10 is illustrated as attached to the upper end of a metal ladder 20 and is placed against an object, in this case a tree 22. It will be noticed that ladder stabilizer 10 includes a plurality of serrations, as at 30, which serrations engage the tree and minimize the possibility of the slipping or sliding of metal ladder 20.

Figure 2:
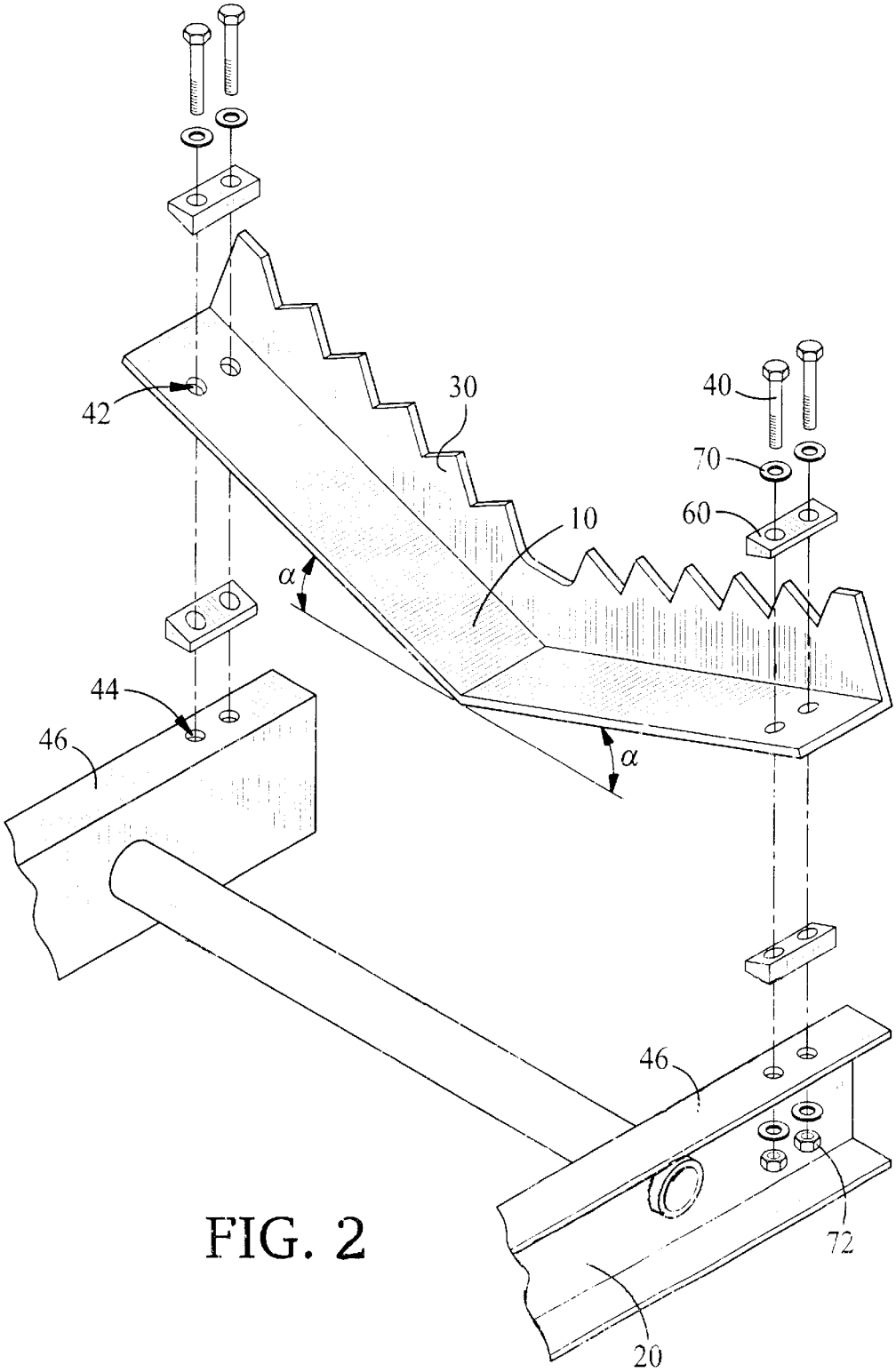
FIG. 2 is an exploded isometric view of the ladder stabilizer, the upper end of the metal ladder, and hardware for attaching the ladder stabilizer to the upper end of the metal ladder.

FIG. 2 illustrates the means of attachment of ladder stabilizer 10 to the upper end of metal ladder 20 and includes four threaded bolts, as at 40, inserted through four holes, as at 42, defined through the ladder stabilizer and aligned with four holes, as at 44, defined through flanges 46 on metal ladder 20. One each of four tapered bearing blocks, as at 60, is provided on either side of the non-serrated portion of ladder stabilizer 10 to provide for the proper placing of the non-serrated portions of the ladder stabilizer against the upper end of metal ladder 20. Eight flat washers, as at 70, (only six shown on FIG. 2) and four locking nuts, as at 72, (only two shown on FIG. 2) complete the hardware for attaching ladder stabilizer 10 to the upper end of metal ladder 20.

Continuing to refer to FIG. 2, the non-serrated portions of ladder stabilizer 10 are bent upwardly from the plane of flanges 46 of metal ladder 20 at an angle $\alpha$ of about 20 degrees. Thus, the ends of the serrated portions of ladder stabilizer 10, being disposed roughly orthogonally to the non-serrated portions of the ladder stabilizer are also bent upwardly about 20 degrees from the plane of flanges 46. Serrations 30 can be spaced apart about 1-½ inches and can be about 1-½ inches high, although serrations 30 having other dimensions and ladder stabilizers having other angles may be provided as well within the contemplation of the present invention. Serrations 30 on the two serrated portions of ladder stabilizer 10 are roughly aligned.

Figure 3:
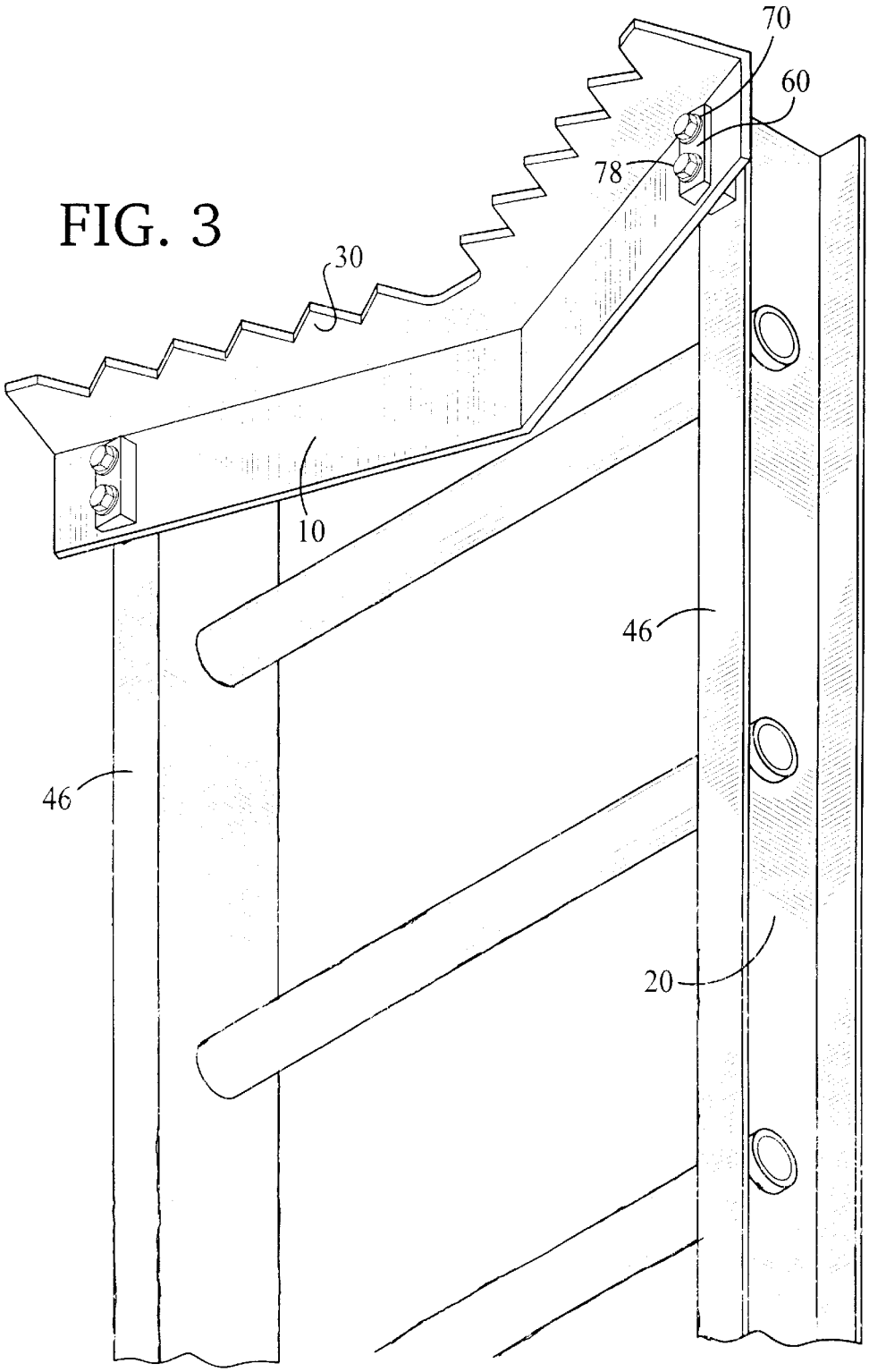
FIG. 3 is an isometric view of the ladder stabilizer attached to the upper end of the metal ladder.

FIG. 3 illustrates more clearly ladder stabilizer 10 attached to the upper end of metal ladder 20, with the elements of the ladder stabilizer and the means for attachment of the ladder stabilizer to the upper end of the metal ladder are as is described above (FIG. 2).

Figure 4:
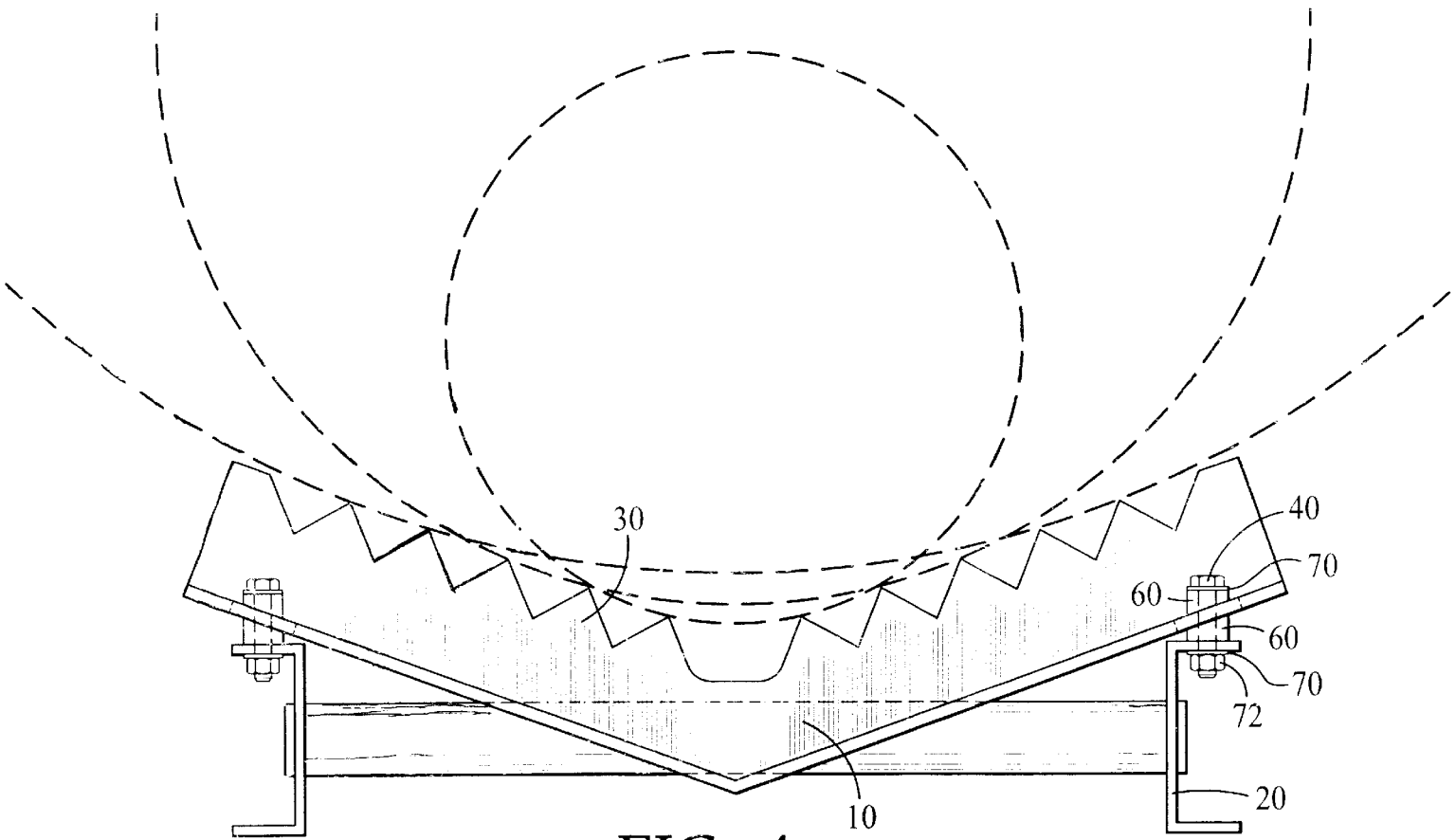
FIG. 4 is a top plan view of the ladder stabilizer attached to the upper end of the metal ladder, showing the wide range of diameters of objects that can be accommodated by the ladder stabilizer.

FIG. 4 illustrates that ladder stabilizer 10 having the above dimensions (FIG. 2) can accommodate a wide range of diameters of objects, here a ratio of diameters of about at least 4 to 1. Other dimensions and angles can be provided to accommodate other diameters.

Figure 5:
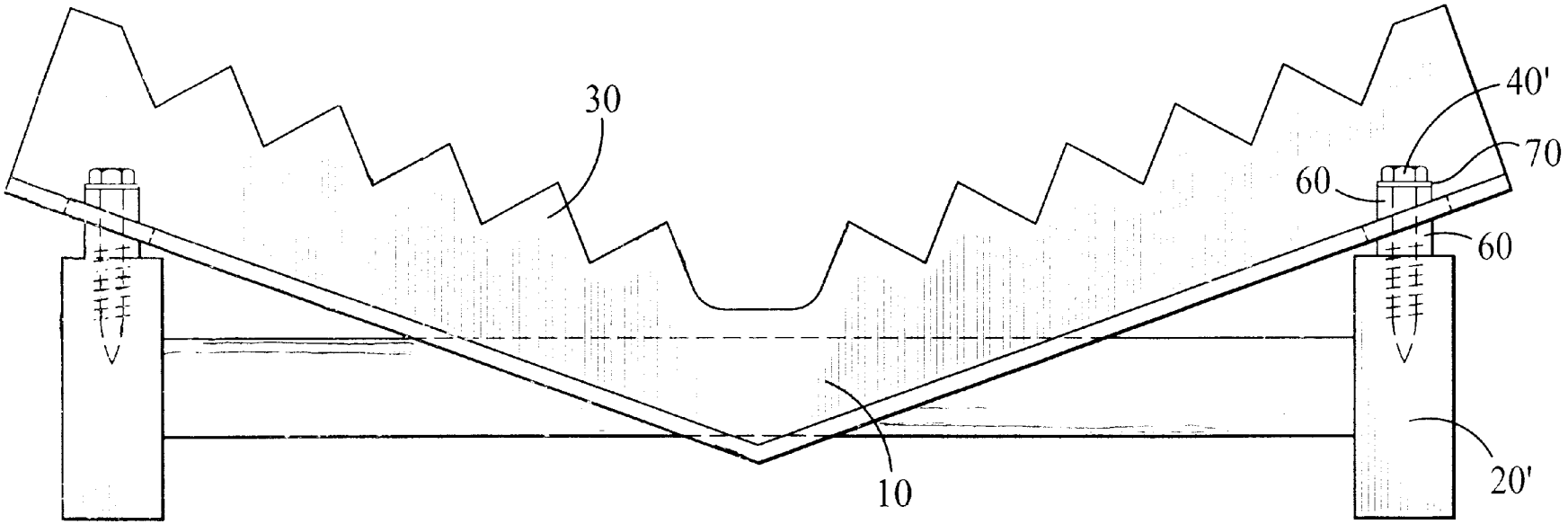
FIG. 5 is an alternative embodiment of the present invention for use with a wooden ladder.

FIG. 5 illustrates an embodiment of the present invention for use with a wooden ladder 20'. Elements of ladder stabilizer 10' shown on FIG. 5 that are identical to the elements of ladder stabilizer 10 (FIG. 2) are given identical reference numerals. Elements of ladder stabilizer 10' that have a different form, but similar function to that of ladder stabilizer 10 are given primed reference numerals. The primary difference between the embodiment shown on FIG. 5 and the embodiment shown on FIG. 2 is that four bolts, as at 40 (FIG. 2), have been replaced with four lag crews, as at 40'. Also, four circular holes, as at 42 (FIG. 2), have been replaced with four slots, as at 42', for slight lateral adjustment of ladder stabilizer 10 on ladder 20'. Such slots could also be provided on the embodiment shown on FIG. 2 or, alternatively, circular openings 42 could be provided on ladder stabilizer 10'.

Ladder stabilizer 10 or 10' can be economically constructed of any suitable metallic or engineering plastic material using conventional methods of manufacture.

In the embodiments of the present invention described above, it will be recognized that individual elements and/or features thereof are not necessarily limited to a particular embodiment but, where applicable, are interchangeable and can be used in any selected embodiment even though such may not be specifically shown.

Terms such as "above", "below", "upper", "lower", "inner", "outer", "inwardly", "outwardly", "vertical", "horizontal", and the like, when used herein, refer to the positions of the respective elements shown on the accompanying drawing figures and the present invention is not necessarily limited to such positions.

It will thus be seen that the objects set forth above, among those elucidated in, or made apparent from, the preceding description, are efficiently attained and, since certain changes may be made in the above construction and method without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

The embodiments of the invention in which an exclusive property or privilege is claimed are defined as follows:

1. A method of using a ladder stabilizer, comprising:

(a) providing a one-piece serrated portion for placement against an object;

(b) attaching said serrated portion directly to an upper end of a ladder (c) placing said ladder against an object, with serrations formed on said serrated portion engaging said object;

(d) providing said serrated portion as planar and comprising two segments extending outwardly from a common joining segment at proximal ends thereof; and (e) providing distal ends of said two segments extending outwardly from a plane defined by edges of said ladder and forming acute angles therewith.

2. The method, as defined in claim 1, further comprising: providing said acute angles about 20 degrees each.

3. The method, as defined in claim 1, further comprising: providing apexes of said serrations on each of said two segments approximately aligned.

* * * * *